US009149904B1

(12) United States Patent
Moudry et al.

(10) Patent No.: US 9,149,904 B1
(45) Date of Patent: Oct. 6, 2015

(54) PLATEN FOR WAFER POLISHING HAVING DIAMOND-CERAMIC COMPOSITES

(71) Applicant: Seagate Technology LLC, Cupertino, CA (US)

(72) Inventors: Raymond Leroy Moudry, Bloomington, MN (US); Mihaela Ruxandra Baurceanu, Edina, MN (US); Joel William Hoehn, Hudson, WI (US); Jeffrey R. O'Konski, Savage, MN (US)

(73) Assignee: SEAGATE TECHNOLOGY LLC, Cupertino, CA (US)

( * ) Notice: Subject to any disclaimer, the term of this patent is extended or adjusted under 35 U.S.C. 154(b) by 12 days.

(21) Appl. No.: 14/304,684

(22) Filed: Jun. 13, 2014

(51) Int. Cl.

| | |
|---|---|
| ***B24B 37/04*** | (2012.01) |
| ***B24B 37/12*** | (2012.01) |
| ***B24D 3/28*** | (2006.01) |
| ***B24D 18/00*** | (2006.01) |

(52) U.S. Cl.
CPC ..... *B24B 37/12* (2013.01); *B24B 37/048* (2013.01); *B24D 3/28* (2013.01); *B24D 18/0072* (2013.01)

(58) Field of Classification Search
CPC ..... B24B 37/12; B24B 37/048; B24D 3/28; B24D 18/0072
USPC ..... 451/526–539, 548–551
See application file for complete search history.

(56) References Cited

U.S. PATENT DOCUMENTS

| | | | | |
|---|---|---|---|---|
| 1,416,728 | A * | 5/1922 | Frederick | 451/550 |
| 1,440,820 | A * | 1/1923 | De Wille | 451/550 |
| 2,776,527 | A * | 1/1957 | Hoyet et al. | 51/293 |
| 3,623,276 | A * | 11/1971 | Twigg | 451/550 |
| 3,731,436 | A * | 5/1973 | Krafft | 451/550 |
| 3,916,584 | A | 11/1975 | Howard et al. | |
| 4,311,489 | A | 1/1982 | Kressner | |
| 5,556,437 | A | 9/1996 | Lee et al. | |
| 5,851,247 | A | 12/1998 | Stoetzel et al. | |
| 5,958,794 | A | 9/1999 | Bruxvoort et al. | |
| 6,582,487 | B2 | 6/2003 | Larson et al. | |
| 6,645,624 | B2 | 11/2003 | Wagle-Peterson et al. | |
| 6,769,969 | B1 * | 8/2004 | Duescher | 451/59 |
| 7,494,519 | B2 | 2/2009 | Fletcher et al. | |
| 7,632,434 | B2 | 12/2009 | Duescher | |
| 8,062,098 | B2 | 11/2011 | Duescher | |
| 8,425,278 | B2 * | 4/2013 | Culler et al. | 451/56 |
| 8,545,583 | B2 | 10/2013 | Duescher | |
| 2003/0114079 | A1 * | 6/2003 | Berkstresser et al. | 451/28 |
| 2007/0020457 | A1 | 1/2007 | Adefris | |
| 2010/0003904 | A1 * | 1/2010 | Duescher | 451/259 |

OTHER PUBLICATIONS

U.S. Appl. No. 13/929,436 (Moudry et al.) filed Jun. 27, 2013 "Method for Forming an Abrasive Lapping Plate".

U.S. Appl. No. 13/716,456 (Moudry et al.) filed Dec. 17, 2012 "Method of Patterning a Lapping Plate, and Patterned Lapping Plate".

* cited by examiner

*Primary Examiner* — George Nguyen
(74) *Attorney, Agent, or Firm* — HolzerIPLaw, PC

(57) ABSTRACT

A lapping platen having a working surface and an abrasive coating on the working surface. The abrasive coating comprises a plurality of individual abrasive composites adhered to the working surface with an epoxy, the abrasive composites comprising diamond particles and a ceramic matrix. The diamond particles have an average particle size of 0.1 micrometers to 3 micrometers with no particle larger than 6 micrometers. The abrasive composites have an average particle size of 15 micrometers to 100 micrometers with no particle larger than 150 micrometers.

20 Claims, 5 Drawing Sheets

PLATEN FOR WAFER POLISHING HAVING DIAMOND-CERAMIC COMPOSITES

BACKGROUND

Hard disc drive systems (HDDs) typically include one or more data storage discs. A magnetic head carried by a slider is used to read from and write to a data track on a disc. In order to achieve maximum efficiency from the magnetic head, the sensing elements must have precision dimensional relationships to each other as well as the application of the slider air bearing surface to the magnetic recording disc. During manufacturing, it is most critical to grind or lap these elements to very close tolerances of desired thickness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. Rotating lapping plates having horizontal lapping surface in which abrasive particles such as diamond fragments are embedded have been used for lapping and polishing purposes in the high precision lapping of magnetic transducing heads. In some of these lapping processes, an abrasive slurry utilizing a liquid carrier containing diamond fragments or other abrasive particles is applied to the lapping surface as the lapping plate is rotated relative to the slider or sliders maintained against the lapping surface. In another process, the abrasive particles are embedded into the surface of the lapping plate, in some implementations with a polymeric resin, resulting in a "fixed" abrasive surface.

SUMMARY

In one implementation, this disclosure provides a lapping platen having a working surface and an abrasive coating on the working surface. The abrasive coating comprises a plurality of individual abrasive composites adhered to the working surface with an epoxy, the abrasive composites comprising diamond particles and a ceramic matrix. The diamond particles have an average particle size of 0.1 micrometers to 3 micrometers with no particle larger than 6 micrometers. The abrasive composites have an average particle size of 15 micrometers to 100 micrometers with no particle larger than 150 micrometers.

In another implementation, this disclosure provides a method of making a lapping platen. The method includes applying an abrasive coating comprising epoxy and abrasive composites comprising diamond particles and a ceramic matrix on a working surface of a lapping platen. The diamond particles have an average particle size of 0.1 micrometers to 3 micrometers with no particle larger than 6 micrometers. The abrasive composites have an average particle size of 15 micrometers to 100 micrometers, with no abrasive composite larger than 150 micrometers.

In yet another implementation, this disclosure provides a method of lapping a wafer or a wafer portion. The method comprises contacting a surface of a wafer or a wafer portion with an abrasive coating on a working surface of a platen. The abrasive coating comprises epoxy and abrasive composites comprising diamond particles and a ceramic matrix, with the diamond particles having an average particle size of 0.1 micrometer to 3 micrometer and no diamond particles larger than 6 micrometers, and with the composites having an average particle size of 15 micrometers to 100 micrometers and no composites larger than 150 micrometers. The method can be, for example, a rough lapping process or a fine lapping process.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. These and various other features and advantages will be apparent from a reading of the following Detailed Description.

BRIEF DESCRIPTIONS OF THE DRAWINGS

DETAILED DESCRIPTION

Figure 1:
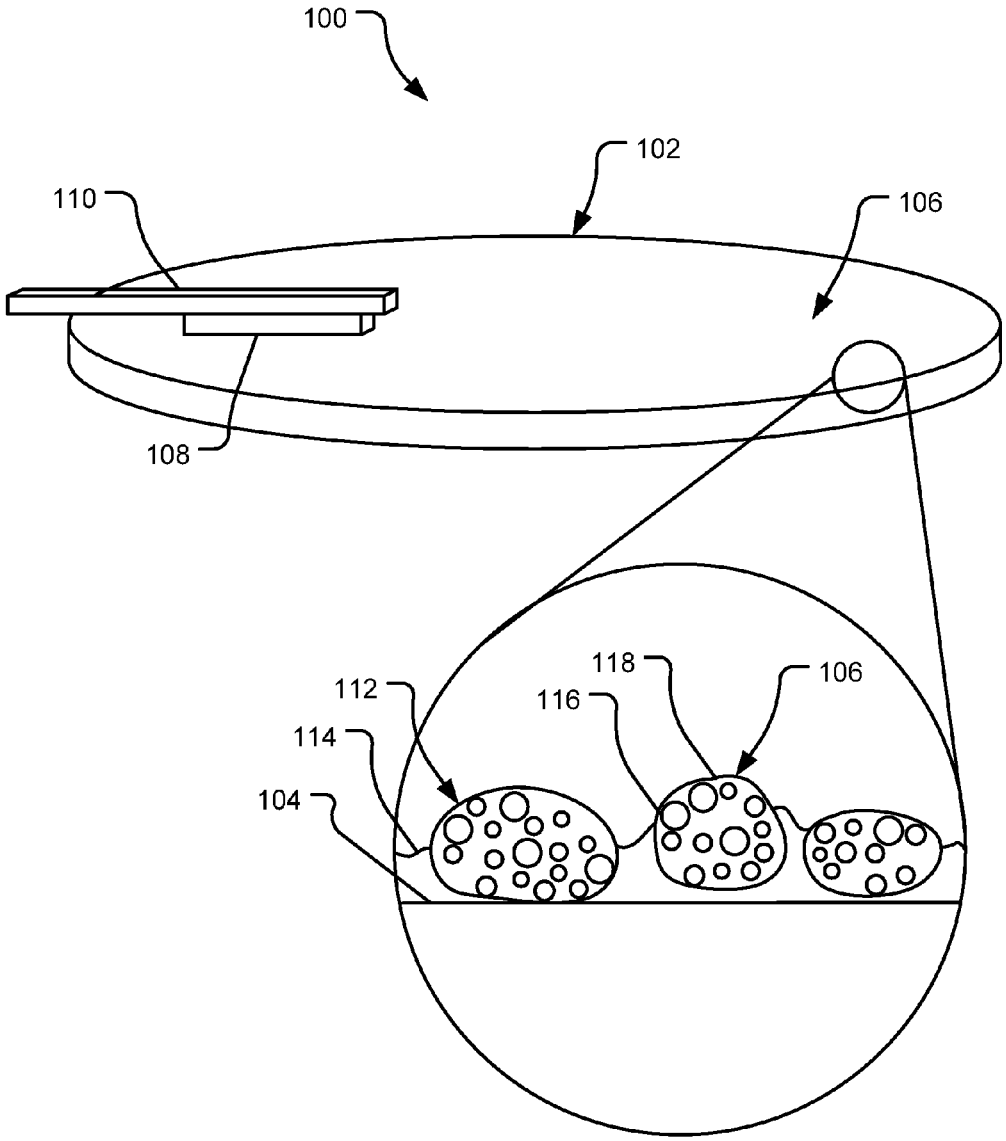
FIG. 1 is a perspective view of an example lapping system.

An exemplary data storage device includes a magnetic storage media such as a disc. Data on the disc is accessed by a corresponding data transducer, or read/write head, on a slider. Magnetic media storage drives store data in polarized cells on the magnetized media disc; the polarized cells are present in generally circular data tracks on the disc. In operation, the disc rotates while information is written to and read from the cells in the tracks by the head. A write pole in the head generates a magnetic field that writes data to a disc by changing the magnetic polarization of the cells on the disc that rotates beneath the head. A read pole in the head reads data from the disc by detecting the magnetic polarization of the cells on the disc.

In order to meet the ever-increasing demands for more and more data storage capacity on the disc, slider fabrication and finishing must continue to improve. To meet these demands, lapping and polishing methodology must be developed which enhance slider features.

Typically, numerous sliders are fabricated from a single wafer having rows of magnetic transducer heads deposited simultaneously on the wafer surface using semiconductor-type processing methods. In some processes, single-row bars are sliced from the wafer, each bar being a row of units that are processed into sliders each having one or more magnetic transducers or heads on their end faces. Each row bar is bonded to a fixture or tool for further processing (e.g., lapping) and then further diced i.e., separated into individual sliders. In other processes, stacks or chunks are sliced from the wafer, each stack having multiple rows of units that are eventually processed into sliders. Each stack is bonded to a fixture or tool for lapping and eventually separated into individual sliders. In still other processes, individual sliders are lapped.

In order to achieve maximum efficiency of the slider during use in the reading/recording operation of the disc drive, the head, particularly the sensing elements of the head, must have precise dimensions. The present disclosure is directed to the use of an abrading tool in high precision lapping of sliders and the supported magnetic transducing heads used in data storage devices. The sliders and particularly the heads, operably used to store and retrieve data on rotatable magnetic recording discs, require extremely precise manufacturing tolerances.

Lapping processes utilize either oscillatory or rotary motion of a slider bar across a rotating lapping plate to provide a random motion of the slider bar over the lapping plate and randomize plate imperfections across the head surface in the course of lapping. Some lapping plates have an abrasiveless horizontal working surface and are used in conjunction with a slurry of abrasive particles (e.g., diamonds), whereas other lapping plates have abrasive particles (e.g., diamonds) embedded in or on the horizontal working surface. The working surface may be a continuous surface having a constant level, or the surface may have random or patterned interruptions in the lapping surface, for example, concentric, radial, or spiral grooves. The interrupted surface reduces hydroplaning of the slider bar on the working surface and facilitates the removal of liquid and debris (swarf) beyond the lap plate peripheral.

The present disclosure provides a method of abrading (lapping) the slider with a lapping plate or platen having an abrasive coating thereon having a plurality of composite abrasive particles, the composite particles having diamond particles retained in a ceramic matrix.

In the following description, reference is made to the accompanying drawing that forms a part hereof and in which are shown by way of illustration at least one specific implementation. The following description provides additional specific implementations. It is to be understood that other implementations are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples provided below.

In some instances, a reference numeral may have an associated sub-label consisting of a lower-case letter to denote one of multiple similar components. When reference is made to a reference numeral without specification of a sub-label, the reference is intended to refer to all such multiple similar components.

Referring to FIG. 1, a top perspective view of a lapping system 100 is shown. System 100 has a lapping plate or platen 102 having a working surface 104. As indicated above, working surface 104 can be a continuous surface having a constant level, or surface 104 may have random or patterned interruptions in the lapping surface, for example, concentric, radial, or spiral grooves. Present on working surface 104 is an abrasive coating 106. A slider row bar 108 (cut from a wafer and containing a plurality of sliders) is held in contact with abrasive coating 106 by an arm assembly 110.

In use, platen 102 is rotated relative to the slider row bar 108 and bar 108 is held in pressing engagement against abrasive coating 106 by assembly 110. The abrading action of abrasive coating 106 removes material from slider bar 108 and provides the desired shape to the slider bar, which includes low crown effects, good stripe control, and good pitch. To be a successful lapping process, the resulting slider bar when tested, for example, should have had a uniform amount of stock removed across the length of the bar, and each of the sliders in the slider bar should have a uniform stripe height.

For conventional lapping processes, the process includes three sequential steps: a rough lapping step, a fine lapping step, and a kiss lapping step. For a rough lapping step, individual abrasive particles (e.g., diamonds) usually about 1 to about 5 micrometers in size, in some implementations as large as 10 micrometers, are used; for a fine lapping step, the individual abrasive particles are usually about 0.1 to about 1 micrometer in size; for a kiss lapping step, the abrasive particles are usually less than 0.1 micrometer (100 nm). The abrasive lapping platens 102 of this disclosure have an advantage over other conventional lapping processes, as these platens 102 allow smaller abrasive particles to be used, while obtaining the same stock removal rate, often with a smoother surface finish. A smoother surface finish in turn results in reduced head-media spacing (HMS), allowing lower slider flying clearance over the magnetic media disc, which can result in more bits per magnetic track.

Turning to the inset of FIG. 1, abrasive coating 106 is present on working surface 104. Abrasive coating 106 has a plurality of abrasive composites 112 held on to working surface 104 by an epoxy adhesive 114. Each abrasive composite 112 has diamond particles 116 retained in a ceramic matrix 118.

Figure 2A:
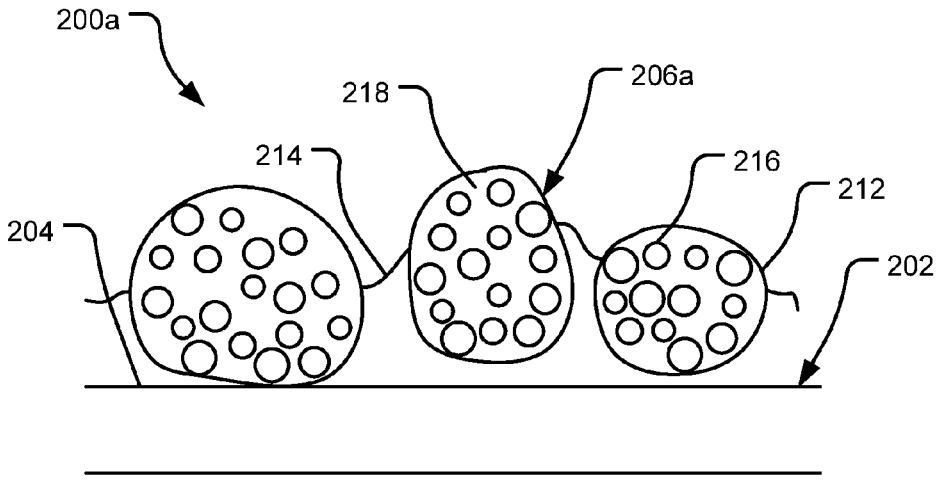
FIGS. 2A and 2B are schematic side views of a lapping platen having an abrasive coating according to this disclosure.
Figure 2B:
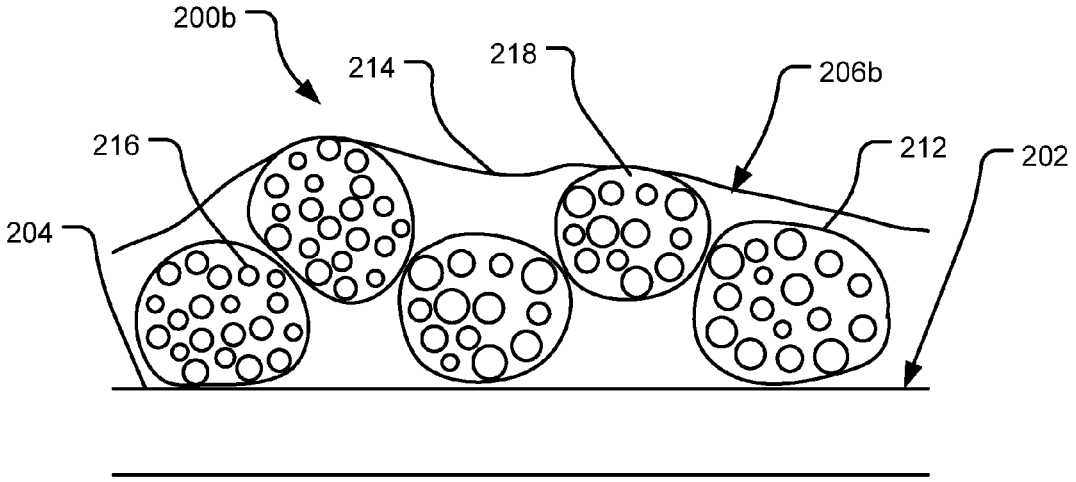

FIGS. 2A and 2B illustrate two examples of abrasive coatings. In FIG. 2A, an article 200*a* has a lapping plate or platen 202 having a working surface 204 with an abrasive coating 206*a* thereon. Abrasive coating 206*a* has abrasive composites 212, formed of diamond particles 216 and ceramic matrix 218, adhered to working surface 204 by epoxy adhesive 214; abrasive coating 206*a* has abrasive composites 212 present more on the top of epoxy adhesive 214 rather than being surrounded by epoxy adhesive 214. In some implementations, abrasive coating 206*a* has a monolayer of abrasive composites 212, whereas in other implementations, abrasive coating has multiple layers of abrasive composites 212. FIG. 2B illustrates an alternate article 200*b*, similar to article 200*a* of FIG. 2A except for the abrasive coating. Article 200*b* has lapping plate or platen 202 having working surface 204 with an abrasive coating 206*b* thereon. Similar to before, abrasive coating 206*b* has abrasive composites 212, formed of diamond particles 216 and ceramic matrix 218, adhered to working surface 204 by epoxy adhesive 214. However, abrasive coating 206*b* has abrasive composites 212 distributed throughout epoxy adhesive 214, whereas abrasive coating 206*a* has abrasive composites 212 present more on the top of epoxy adhesive 214. As another characterization, abrasive coating 206*a* has epoxy adhesive 214 essentially surrounding abrasive composites 212. Abrasive coating 206*b* is a multilayer coating, having more than a single layer of abrasive composites 212 on surface 204.

The structural differences in abrasive coatings 206*a*, 206*b* can be due to the different methods of making the coatings, two example methods which are described below.

Referring to both FIG. 2A and FIG. 2B, platen 202 and working surface 204 may be formed of any suitably rigid material such as metal, ceramic, hard polymeric material, or combinations thereof. Platen 202 may be a single structure or may be formed from layers; in some implementations, platen 202 includes a base layer and a different top layer that forms platen surface 204. Non-limiting examples of suitable materials for platen 202 and/or working surface 204 include tin, tin alloy, copper, and aluminum.

Diamond particles 216 have an average particle size no greater than 3 micrometers, in some implementations no greater than 2.6 micrometers, and in some implementations no greater than 1.5 micrometers. In some implementations, there is no diamond particle 216 with a particle size greater than 6 micrometers, and in other implementations, there is no diamond particle 216 greater than 5 micrometers.

Diamond particles 216 can have an average particle size of 1 to 3 micrometers (for example, for a rough lapping step), or 0.1 to 1 micrometer or 0.1 to 0.7 micrometer or 0.1 to 0.5 micrometer (for example, for a fine lapping step). The particle size distribution of diamond particles 216 is fairly tight, with no particle present in the distribution that has a size that is more than 3× the average particle size. By incorporating diamond particles 216 into a composite, it has been found that diamond particles 216 having a smaller particle size can be used to obtain the same stock removal rate without sacrificing life of the abrasive particles. As a benefit, the smaller diamond particles produce a finer surface finish on the slider row bar being lapped.

Diamond particles 216 may be natural diamonds or manufactured, polycrystalline or single crystal, they may be crushed and screened to size, and they may be either block or sharp. They can include a surface coating to improve the bond with ceramic matrix 218.

Diamond particles 216 are held together with ceramic matrix 218 to form abrasive composites 212. Diamond particles 216 occupy at least 10 wt-% of abrasive composite 212, for example, 20 wt-% to 60 wt-%, and in some implementations diamond particles 216 occupy 40 wt-% to 50 or 60 wt-% of abrasive composite 212. Preferably, diamond particles 216 are distributed evenly throughout abrasive composite 212. The weight ratio of diamond particles 216 to ceramic matrix 218 in abrasive composites 212 can be, for example, 1:2 to 1.5:1, or, about 1:1.

Ceramic matrix 218 may be amorphous (non-crystalline) or crystalline, and have a hardness of at least 9 Mohs (diamond has a hardness of 10 Mohs). Examples of suitable materials for ceramic matrix 218 include zirconia, alumina, chromia, silica, zinc oxide, titanium oxide, boron, boron nitride, titanium diboride; the materials may be doped, for example, with other oxides, such as yttria.

Any suitable fillers or additives may be present in composites 212 in addition to diamond particles 216 and ceramic matrix 218. Examples of fillers include other abrasive particles, non-abrasive particles, lubricant particles, clay, glass bubbles, plasticizers, etc.

Abrasive composites 212 have an average particle size no greater than 100 micrometers, in some implementations no greater than 80 micrometers, and in other implementations no greater than 50 micrometers. In some implementations there is no abrasive composite 212 with a particle size greater than 150 micrometers. Abrasive composites 212 in abrasive coating 206*a* or 206*b* can have, for example, an average particle size of 15-80 micrometers, or, 20-40 micrometers, or, 15-35 micrometers.

Abrasive composites 212 can have an irregular shape (e.g., formed by being crushed) or can have a precise, formed, or molded shape. For example, abrasive composites 212 can be beads or spheres or semi-spherical.

Epoxy adhesive 214 holds abrasive composites 212 onto platen surface 204. Epoxies are from a class of reactive prepolymers and polymers that contain epoxide groups. Epoxy resins may be reacted (i.e., cross-linked) either with themselves through catalytic homopolymerisation, or with a wide range of co-reactants including polyfunctional amines, acids (and acid anhydrides), phenols, alcohols, and thiols. These co-reactants are often referred to as 'hardeners' and the cross-linking reaction is commonly referred to as 'curing'. Epoxy, in general, is readily available, is fairly inexpensive, is easy to apply, and results in a robust, high hardness coating. The cured epoxy is non-water soluble and non-soluble in the solvents used during the lapping process.

Abrasive coating 206 may include any optional additives such as fillers, lubricants, surfactants, dyes, etc.; these fillers may be pre-mixed with the adhesive, may be subsequently applied to the epoxy adhesive 214 after adhesive 214 is applied to platen surface 204, or may be applied to surface 204 before epoxy adhesive 214 is applied to surface 204.

Abrasive coating 206 has a thickness no greater than 110 micrometers, in some implementations no greater than 100 micrometers. Exemplary coating thicknesses include no more than 80 micrometers and no more than 40 micrometers, and no less than 15 micrometers thick, and no less than 20 micrometers. Because of the relatively large abrasive composites 212, compared to the size of the diamond particles 216, significantly thicker abrasive coatings 206 are obtained with abrasive composites 212 than if individual diamond abrasive particles were adhered to surface 204. Even though the thickness of abrasive coating 206 is large, including a fairly thick layer of polymeric (epoxy) adhesive, it was found that the coating thickness does not deleteriously fluctuate under pressure, as is the experience with abrasive coatings on polymeric backings (e.g., commercially available lapping films). Because compression of abrasive coating 206 is inhibited, the result is a more accurate lapping process, resulting in low crowning and good stripe control of the slider row bar.

Figure 3A:
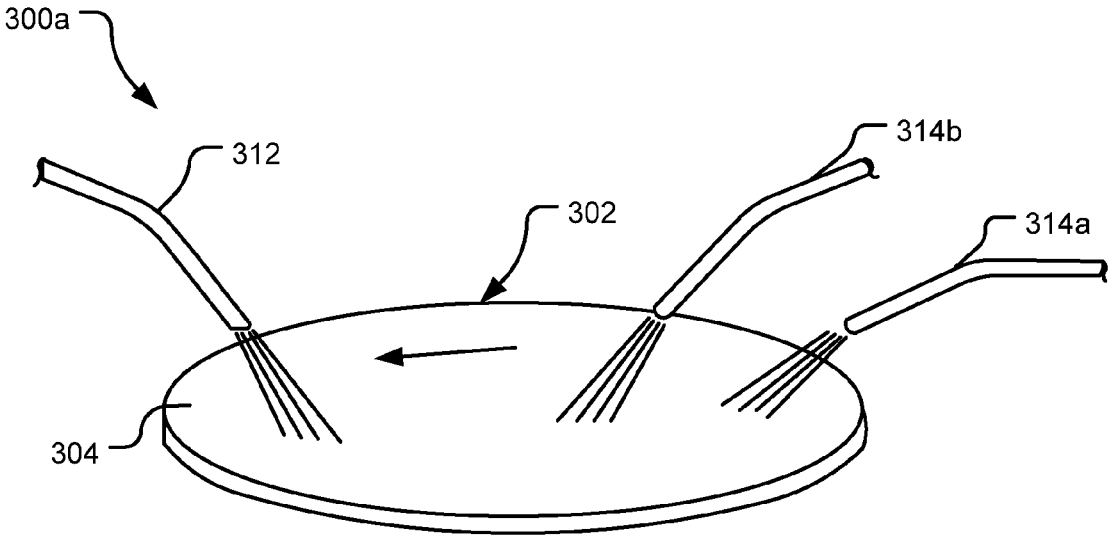
FIGS. 3A and 3B are schematic perspective views of systems suitable for making the lapping platens of FIGS. 2A and 2B, respectively.
Figure 3B:
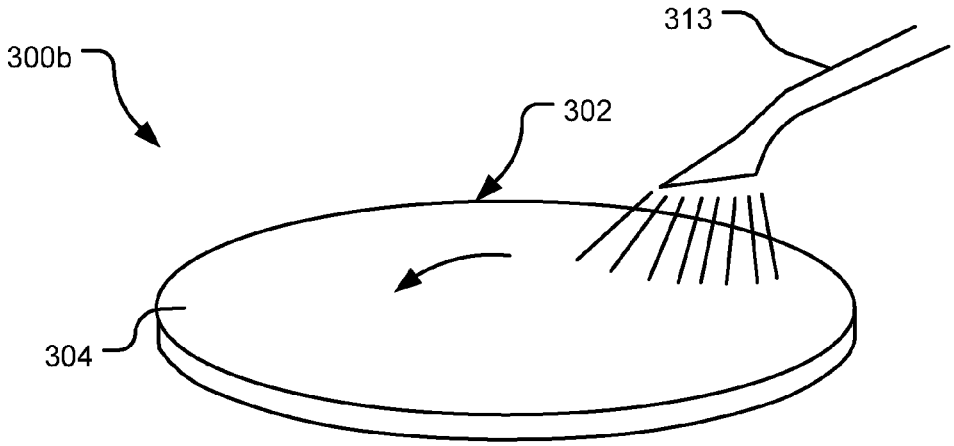

As indicated above, the two different abrasive coatings 206*a* and 206*b* can be formed by two different methods; FIGS. 3A and 3B show two possible methods.

In one implementation, to form article 200*a* of FIG. 2A having abrasive coating 206*a*, the epoxy adhesive is applied to working surface 204 prior to the abrasive composites being applied. Turning to FIG. 3A, the abrasive composites are applied (e.g., sprayed) onto a platen surface separately from the epoxy adhesive, in most implementations after at least a portion of the adhesive has been sprayed onto the platen surface.

FIG. 3A shows a system 300*a* that includes at least two spray applicators or spray nozzles, at least one for applying epoxy adhesive and one for applying the abrasive composites. The system includes a mechanism, not shown, for rotating platen 302 and its surface 304. In the illustrated implementation, system 300*a* includes a spray applicator or nozzle 312 for applying abrasive composites and two spray applicators or spray nozzles 314*a*, 314*b* for applying epoxy adhesive onto surface 304, for example, nozzle 314*a* applies the epoxy and nozzle 314*b* applies the hardener. Other systems may have one spray applicator or nozzle for the epoxy, depending on the adhesive and how it is applied. For example, the same spray applicator or nozzle could be used for two epoxy adhesive components. Nozzles 312, 314 are appropriately connected to supply lines, holding tanks, etc. of the material being applied by each nozzle 312, 314.

In some implementations, the abrasive composites may be carried in a liquid, thus resulting in a slurry being applied; any liquid carrier for the abrasive composites should not detrimentally affect the epoxy adhesive. Examples of suitable carriers for the abrasive composites include water, alcohols (e.g., ethanol, methanol, isopropyl alcohol (IPA), etc.), glycols (e.g., propylene glycol DMA or glycol ether DMA, also referred to as di(propylene glycol) mono methyl ether).

Nozzles 312, 314 are configured to produce a fine mist or spray of the material being applied thereby, if the material is liquid or in a liquid carrier. In some implementations, the liquid material can be referred to as having been "atomized". For particulate material, such as abrasive composites, the nozzle is configured to produce a thin and uniform layer of material. A carrier, such as air or inert gas may be used; in some implementations, a propellant may be used.

The epoxy adhesive or components of the epoxy adhesive (such the two components of an epoxy), prior to curing, have a sufficiently low viscosity to allow the adhesive to be sprayed onto platen surface 304. In some implementations, the viscosity is no more than about 50 cps, and in other implementations is about 20-40 cps. The epoxy adhesive may be diluted with solvent to obtain an acceptable viscosity and facilitate spraying.

The droplets or layer of material, as applied by nozzles 312, 314, are sufficiently small to cover platen surface 304 without globules of adhesive or abrasive yet sufficiently large that a fog is not created. Individual nozzles 312, 314 may produce different size droplets, and the droplets may be monodisperse or polydisperse. For example, it may be desired to have the abrasive composites applied with larger droplets than the polymeric adhesive. Further, individual nozzles 312, 314 may apply different coating weights of material.

Do to the rotation direction of platen 302 in the particular system 300*a* illustrated in FIG. 3A, epoxy adhesive is applied to platen surface 304 by nozzles 314*a* and 314*b* prior to abrasive composites being applied by nozzle 312. The resulting abrasive coating has abrasive composites present at the top of the epoxy adhesive layer.

In some implementations, the abrasive composites are mixed together with and spraying simultaneously with one of the epoxy components (e.g., either the epoxy or the hardener).

FIG. 3B shows a system 300*b* where the epoxy adhesive and the abrasive composites are applied to platen surface 304 simultaneously by a nozzle 313, providing an abrasive coating having the abrasive composites distributed throughout the epoxy, such as the abrasive coating of FIG. 2B. The epoxy adhesive may be applied as a liquid or as solid particulate, mixed together with abrasive composites and thus applied simultaneously. As an example, beads of solidified "hot melt" epoxy may be applied together with the abrasive composites, for example, at a ratio of epoxy adhesive to abrasive composites of 1:1, 3:1, and levels therebetween. After application, platen 302 is heated (e.g., to about 150° C.), melting the epoxy and causing it to flow and form an adhesive layer retaining the abrasive composites. As another example, beads of UV curable epoxy may be applied together with the abrasive composites, and the coating platen 302 exposed to UV radiation, activating the epoxy and causing it to form an adhesive layer retaining the abrasive composites. System 300*b* may utilize power spray or static gun technology.

It should be understood that other methods of making the abrasive coatings on the platen exist, and that this invention is not limited to the methods described herein.

Typically, the abrasive coating resulting from both system 300*a* and system 300*b* covers the entire platen surface 304 with an abrasive coating having a consistent thickness, although in some implementations the abrasive coating may be patterned, such as with a mask, to provide areas of platen surface 304 void of abrasive coating. Depending on the coating weight of the epoxy adhesive and/or of abrasive composites, in some implementations a discontinuous coating (e.g., with pin holes) may be formed.

Figure 4A:
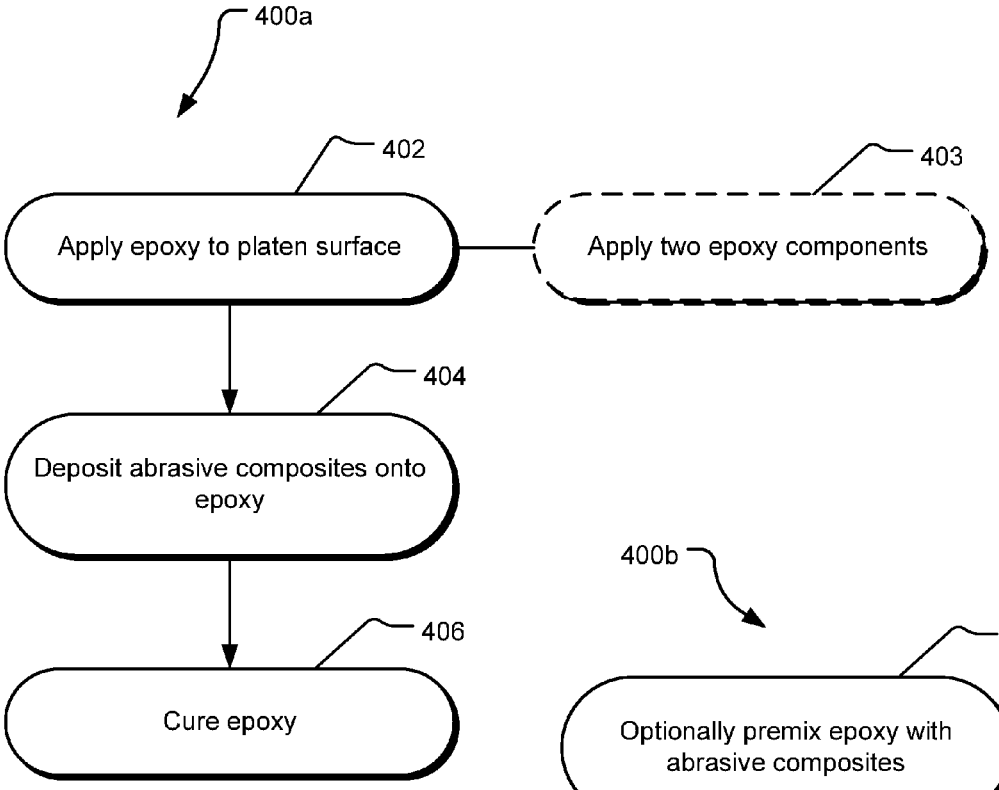
FIGS. 4A and 4B are block diagrams of example methods suitable for making the lapping platens of FIGS. 2A and 2B, respectively.
Figure 4B:
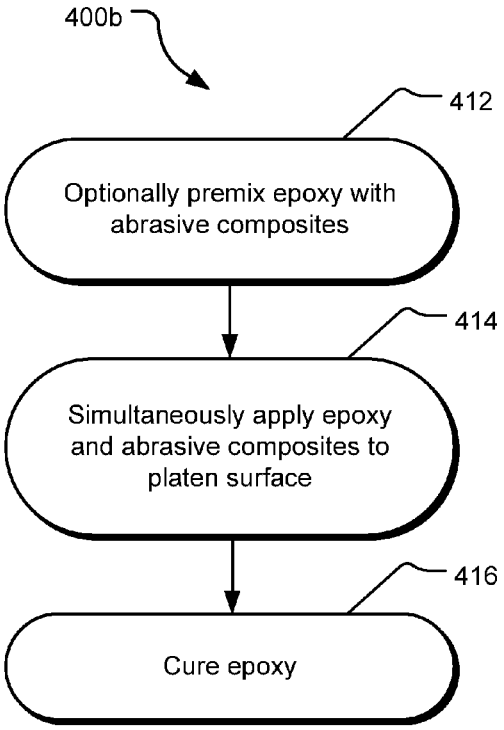

FIGS. 4A and 4B outline additional methods for forming abrasive article 200*a* of FIG. 2A and abrasive article 200*b* of FIG. 2B, respectively.

A method 400*a* (for forming, for example, abrasive article 200*a*) includes an operation 402 to apply the epoxy adhesive to the platen working surface; this may be done by applying the two components of the epoxy adhesive separately, as per operation 403, or separately. Next, in operation 404, abrasive composites are deposited onto the epoxy o the platen surface. The epoxy is cured in operation 406, resulting in an abrasive coating.

An alternate method 400*b* (for forming, for example, abrasive article 200*b*) includes an optional operation 402 of premixing epoxy adhesive with the abrasive composites. In operation 414, the epoxy and the abrasive composites are simultaneously applied to the plate working surface, whether premixed or not. The epoxy is cured in operation 416, resulting in an abrasive coating.

Figure 5A:
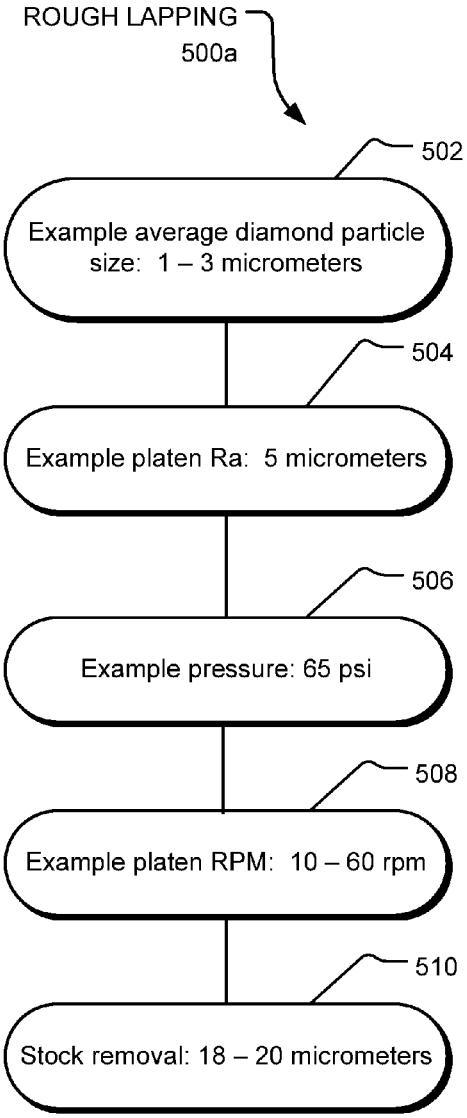
FIGS. 5A and 5B are block diagrams of example conditions for lapping.

As indicated above, two common steps in a lapping process are rough lapping and fine lapping. For a rough lapping step using individual diamond abrasive particles, the particles are usually about 1 to about 5 micrometers in size, and in some implementations as large as 10 micrometers. By utilizing diamond-ceramic abrasive composites, as per this disclosure, smaller diamond abrasive particles can be used, a better surface finish is achieved with reduced residual bar stress, longer life of the abrasive article (i.e., the coating on the platen surface) is achieved, which provides a reduction in the amount of platen rework needed, thus saving time and money. FIG. 5A provides parameters for an example rough lapping process 500*a* that utilizes diamond-ceramic abrasive composites. For process 500*a*, an average diamond particle size is 1-3 micrometers (block 502) in the abrasive composites, which provides a surface roughness (Ra) of the platen of about 5 micrometers (block 504). During the lapping process, the working pressure between the abrasive article and the slider row bar is about 65 psi (block 506), although some high and lower pressures would also be suitable, and the platen rotates at 10-60 rpm (block 508). A typical stock removal total, from a slider row bar for process 500*a*, is 18-20 micrometers (block 510).

Figure 5B:
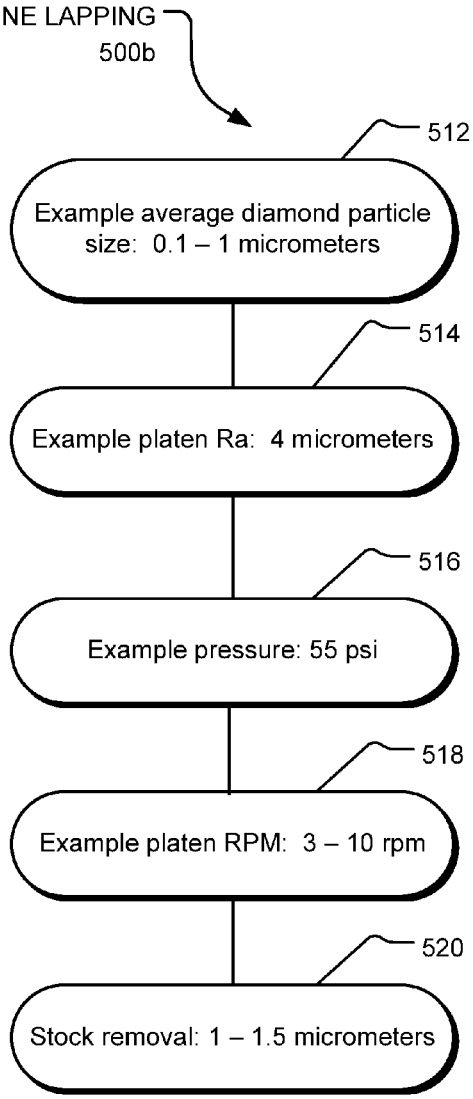

For a fine lapping step using individual diamond abrasive particles, the particles are usually about 0.1 to about 1 micrometer in size. By utilizing diamond-ceramic abrasive composites, as per this disclosure, smaller diamond abrasive particles can be used, a better surface finish is achieved with reduced residual bar stress, and longer life of the abrasive article is achieved. FIG. 5B provides parameters for a fine lapping process 500*b* that utilizes diamond-ceramic abrasive composites. For process 500*b*, an average diamond particle size is 0.1-1 micrometers (block 512) in the abrasive composites, which provides a surface roughness (Ra) of the platen of about 4 micrometers (block 514). During the lapping process, the working pressure between the abrasive article and the slider row bar is about 55 psi (block 516), although some high and lower pressures would also be suitable, and the platen rotates at 3-10 rpm (block 518). A typical stock removal total, from a slider row bar for fine lapping process 500*b*, is 1-1.5 micrometers.

The above specification, examples, and data provide a complete description of the structure and use of exemplary implementations of the invention. The above description provides specific implementations. It is to be understood that other implementations are contemplated and may be made without departing from the scope or spirit of the present disclosure. The above detailed description, therefore, is not to be taken in a limiting sense. While the present disclosure is not so limited, an appreciation of various aspects of the disclosure will be gained through a discussion of the examples provided.

Unless otherwise indicated, all numbers expressing feature sizes, amounts, and physical properties are to be understood as being modified by the term "about." Accordingly, unless indicated to the contrary, the numerical parameters set forth are approximations that can vary depending upon the desired properties sought to be obtained by those skilled in the art utilizing the teachings disclosed herein.

As used herein, the singular forms "a", "an", and "the" encompass implementations having plural referents, unless the content clearly dictates otherwise. As used in this specification and the appended claims, the term "or" is generally employed in its sense including "and/or" unless the content clearly dictates otherwise.

Spatially related terms, including but not limited to, "lower", "upper", "beneath", "below", "above", "on top", etc., if used herein, are utilized for ease of description to describe spatial relationships of an element(s) to another. Such spatially related terms encompass different orientations of the device in addition to the particular orientations depicted in the figures and described herein. For example, if a structure depicted in the figures is turned over or flipped over, portions previously described as below or beneath other elements would then be above or over those other elements.

Since many implementations of the invention can be made without departing from the spirit and scope of the invention, the invention resides in the claims hereinafter appended. Furthermore, structural features of the different implementations may be combined in yet another implementation without departing from the recited claims.

What is claimed is:

1. A lapping platen comprising:

a working surface; and an abrasive coating comprising a plurality of individual abrasive composites adhered to the working surface with an epoxy, the abrasive composites comprising diamond particles and a ceramic matrix, wherein:

the diamond particles have an average particle size of 0.1 micrometers to 3 micrometers;

the diamond particles have a particle size no larger than 6 micrometers;

the abrasive composites have an average particle size of 15 micrometers to 100 micrometers; and the abrasive composites have a particle size of no larger than 150 micrometers.

2. The lapping platen of claim 1, wherein the abrasive composites comprise 40 wt-% to 60 wt-% diamond particles.

3. The lapping platen of claim 1, wherein the abrasive coating comprises a plurality of layers of abrasive composites.

4. The lapping platen of claim 1, wherein the abrasive composites are beads.

5. The lapping platen of claim 1, wherein the ceramic matrix is non-crystalline.

6. The lapping platen of claim 1, wherein the ceramic matrix is crystalline.

7. The lapping platen of claim 1, wherein:

the diamond particles have an average particle size of no larger than 1.5 micrometers;

the diamond particles have a particle size no larger than 5 micrometers;

the abrasive composites have an average particle size no larger than 80 micrometers; and the abrasive composites have a particle size of no larger than 100 micrometers.

8. A method of making a lapping platen, comprising:

applying an abrasive coating comprising epoxy and abrasive composites comprising diamond particles and a ceramic matrix on a working surface of a lapping platen, wherein:

the diamond particles have an average particle size of 0.1 micrometers to 3 micrometers;

the diamond particles have a particle size no larger than 6 micrometers;

the abrasive composites have an average particle size of 15 micrometers to 100 micrometers; and the abrasive composites have a particle size of no larger than 150 micrometers.

9. The method of claim 8, wherein applying an abrasive coating comprises:

applying the epoxy on the working surface; and applying the abrasive composites on the epoxy.

10. The method of claim 9, wherein applying an abrasive coating comprises:

spraying an epoxy part on the working surface;

spraying an epoxy hardener on the epoxy part; and spraying the abrasive composites on the epoxy hardener.

11. The method of claim 8, wherein applying an abrasive coating comprises:

mixing the epoxy and the abrasive composites; and spraying the mixture of the epoxy and the abrasive composites on the working surface.

12. A method of lapping a wafer or a wafer portion, the method comprising:

contacting a surface of a wafer or a wafer portion with an abrasive coating on a working surface of a platen, the abrasive coating comprising epoxy and abrasive composites comprising diamond particles and a ceramic matrix, with the diamond particles having an average particle size of 0.1 micrometer to 3 micrometer and no diamond particles larger than 6 micrometers, and with the composites having an average particle size of 15 micrometers to 100 micrometers and no composites larger than 150 micrometers.

13. The method of claim 12, wherein the diamond particles have an average diamond particle size of 1 to 3 micrometers.

14. The method of claim 13, removing 18 to 20 micrometers of wafer.

15. The method of claim 13, wherein a pressure between the wafer or wafer portion and the abrasive coating is about 65 psi.

16. The method of claim 13, wherein the platen rotates at 10 to 60 rpm.

17. The method of claim 12, wherein the diamond particles have an average diamond particle size of 0.1 to 1 micrometers.

18. The method of claim 17, removing 1 to 1.5 micrometers of wafer.

19. The method of claim 17, wherein a pressure between the wafer or wafer portion and the abrasive coating is about 55 psi.

20. The method of claim 17, wherein the platen rotates at 3 to 10 rpm.

* * * * *